US007395921B2

(12) United States Patent
Errera

(10) Patent No.: US 7,395,921 B2
(45) Date of Patent: Jul. 8, 2008

(54) REUSABLE PACKAGING FOR TOKENS OR COINS

(75) Inventor: David Errera, Brussels (BE)

(73) Assignee: NHE SPRL, Brussels (BE)

( * ) Notice: Subject to any disclaimer, the term of this patent is extended or adjusted under 35 U.S.C. 154(b) by 493 days.

(21) Appl. No.: 10/552,045

(22) PCT Filed: May 24, 2004

(86) PCT No.: PCT/EP2004/050900

§ 371 (c)(1),
(2), (4) Date: Oct. 3, 2005

(87) PCT Pub. No.: WO2004/104949

PCT Pub. Date: Dec. 2, 2004

(65) Prior Publication Data

US 2006/0237334 A1 Oct. 26, 2006

(30) Foreign Application Priority Data

May 23, 2003 (EP) ..... 03101492

(51) Int. Cl.
*A45C 1/00* (2006.01)

(52) U.S. Cl. ..... 206/0.8; 206/0.83; 206/0.84

(58) Field of Classification Search ..... 206/0.8, 206/0.82, 0.83, 0.84, 303, 445, 467, 470, 206/486, 488; 220/4.21, 4.22, 4.23, 835, 220/839

See application file for complete search history.

(56) References Cited

U.S. PATENT DOCUMENTS 3,981,395 A 9/1976 Dalgleish
4,234,080 A * 11/1980 Gellert ..... 206/0.82
4,240,544 A * 12/1980 Barnhart et al. ..... 206/0.82
4,290,523 A * 9/1981 Wallace ..... 206/0.82
4,541,528 A * 9/1985 Holmes ..... 206/0.82
5,957,275 A * 9/1999 Lemaire ..... 206/83
6,851,551 B2 * 2/2005 Lemaire ..... 206/0.83

FOREIGN PATENT DOCUMENTS

| | | |
|---|---|---|
| DE | 34 04 486 | 8/1985 |
| EP | 1 262 927 | 12/2002 |
| FR | 1 363 305 | 6/1964 |
| FR | 2 057 449 | 4/1971 |
| WO | WO 97/05799 | 2/1997 |

* cited by examiner

*Primary Examiner*—David T. Fidei
(74) *Attorney, Agent, or Firm*—Carlson, Gaskey & Olds

(57) ABSTRACT

The invention relates to a reusable packaging for tokens or coins, comprising an essentially semi-cylindrical trough (2), for retaining the coins or tokens, formed by alternating a first series of semi-cylindrical sections (8) with a common axis perpendicular to the plane of the coins or tokens and a second series of semi-cylindrical sections (10) with a common axis, vertically recessed with relation the first series (8), the axes of the first and second series begin parallel to each other. Two folding wings (4) are arranged longitudinally to both sides of the trough (2). Each of said wings (4) is connected with articulation to a cover (6) of cylindrical segment, formed, as for the trough, by the alternation of a first series (12) of cylindrical segments with a common axis, perpendicular to the plane of the coins or tokens and a second series of cylindrical segment sections (14) with a common axis, the covers (6,6), corresponding to each of the wings (4), being mutually interlocking.

15 Claims, 1 Drawing Sheet

REUSABLE PACKAGING FOR TOKENS OR COINS

REFERENCE TO RELATED APPLICATIONS

This application claims priority of PCT Application PCT/EP2004/050900 filed on May 24, 2004, which claims priority to European Patent Application EP 03101492.1 filed on May 23, 2003.

FIELD OF THE INVENTION

The invention relates to reusable packaging for tokens or coins.

BACKGROUND OF THE INVENTION

WO 9705799 discloses coin-handling cases made up of two half-cylindrical cradles reinforced with stiffeners.

FR-2 057 449 and DE-34 04 486 disclose coin boxes in which, for ease of counting, the coins are arranged obliquely, in staggered series alternating to the left and right. The same principle is used in EP 1 262 927 for packaging composed of two half-cradles, which also have laterally staggered series.

To bring down the unit cost of these packaging, efforts are made to produce them using as little plastic material as possible. A delicate balance must therefore be achieved between the strength of the packaging and its thickness. As a consequence, especially if they are not completely filled, most packaging have poor impact and torsional strength, and no small amount of time is wasted during handling, especially when opening and closing them. In addition, in EP 1 262 927, the presence of an axial hinge prevents the coins or tokens being held firmly and tends to cause them to flop about, making them difficult to arrange efficiently.

SUMMARY OF THE INVENTION

It is an object of the invention to market packaging that are both robust and cheap, suitable for high production rates, and that are more stable and facilitate counting by holding the coins securely.

It is another object of the invention to enable less common plastics, such as PLA, to be used effectively.

To this end, the reusable packaging according to the invention comprises

- a half-cylindrical cradle suitable for holding coins or tokens and formed by the alternation of a first series of half-cylindrical lengthwise sections with a common axis perpendicular to the plane of the coins or tokens, and of a second series of half-cylindrical lengthwise sections with a common axis set back vertically from the first series, the axis of the first and second series being parallel. Two folding flaps are arranged longitudinally on either side of the cradle. These flaps, which are of a box structure, are hinged to the cradle. The free edge of each of these flaps is joined in a hinged manner to a cover in the form of a cylindrical segment formed by the alternation of a first series of lengthwise sections of cylindrical segments with a common axis perpendicular to the plane of the coins or tokens, and of a second series lengthwise sections of cylindrical segments with a common axis set back vertically from the first series. The axes of the first and second series of lengthwise sections of segments are parallel, the covers corresponding to each of the flaps being mutually engageable. The cradle comprises a box-structure foot extending virtually along its full length.

In a preferred embodiment, the covers each comprise a longitudinal projection, the projections of the two covers being mutually engageable. These engageable projections have a role both as a closing system and as a damping box structure.

In an advantageous embodiment, at least one engageable stud, male and female, is provided on the set-back series of lengthwise sections of segments of the covers.

In another advantageous embodiment at least the lengthwise sections of the second series of the cradle encircle the coins or tokens around an angle of at least 180°. Additionally, the lengthwise sections of the first series of the cradle may also encircle the coins or tokens around an angle of at least 180°.

There preferably remains a gap between the bottom of the box structure and the base of the coins or tokens, when they are in place, so that the box structure has a role as a shock absorber.

At least one of the covers advantageously comprises a longitudinal tab, allowing easy opening of the packaging after it has been reclosed.

BRIEF DESCRIPTION OF THE FIGURES

These and other aspects of the invention will be clarified in the detailed description of certain particular embodiments of the invention, reference being made to the drawings of the figures, in which.

The figures are not drawn to scale. Similar elements are generally denoted by similar references in the different figures.

DETAILED DESCRIPTION OF PARTICULAR EMBODIMENTS

Figure 1:
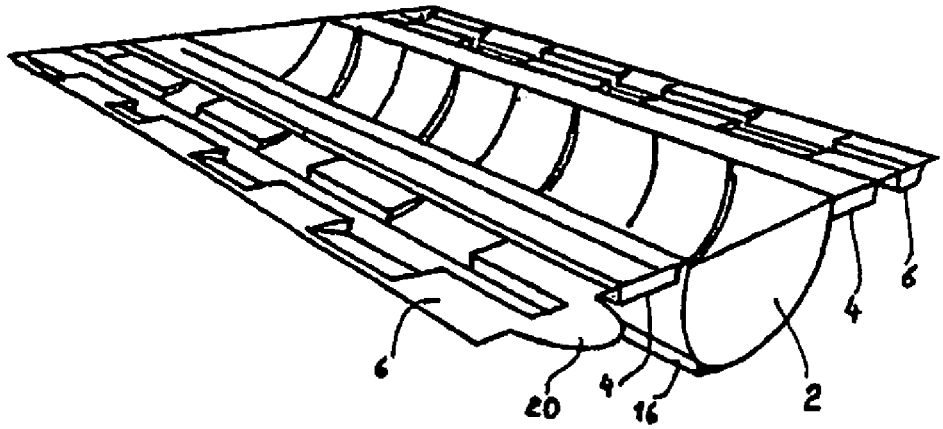
FIG. 1 is a perspective view of a packaging according to the invention, open.

The reusable packaging for tokens or coins shown in FIG. 1 essentially comprises a basically half-cylindrical cradle 2 to which are attached two longitudinally arranged box-structure flaps 4. The free edges of the flaps are joined to two covers 6 in the form of segments of a cylinder.

All these elements (2, 4, 6) are hinged to each other in such a way that they can encircle the coins placed in the cradle, the faces of these coins or tokens thus being in a plane essentially perpendicular to the axis of the cradle.

The cradle is subdivided into two series of alternating adjacent half-cylindrical lengthwise sections.

A first series of lengthwise sections 8 are aligned along a common longitudinal axis $X_1$, and a second series of lengthwise sections 10 are aligned along a second axis $X_2$, which is offset vertically downwards relative to the axis $X_1$ of the first series 8.

The cradle 2 conforms furthermore to the curvature or external shape of the coins or tokens for which the packaging is designed, the coins therefore being arranged in the open cradle 2 in packets which are offset alternately upwards and downwards. The number of coins or tokens in each packet is determined, of course, by considerations of ease of counting.

The offset of the coins placed in the cradle is also found in the two covers 6, which are designed to overlap each other and engage mutually.

Each of the covers 6 therefore comprises a first series of lengthwise sections 12 of cylindrical segments with a common axis $Y_1$ and a second series of lengthwise sections 14 of segments with a common axis $Y_2$ that is offset upwards compared to $Y_1$ when the packaging is, as here, in the open position. As shown in the two figures, the part of the cover that corresponds to the first series 12 is here practically flat when the packaging is open. Clearly, however, its curvature may be more or less pronounced depending on the dimensions of the coins etc.

Figure 2:
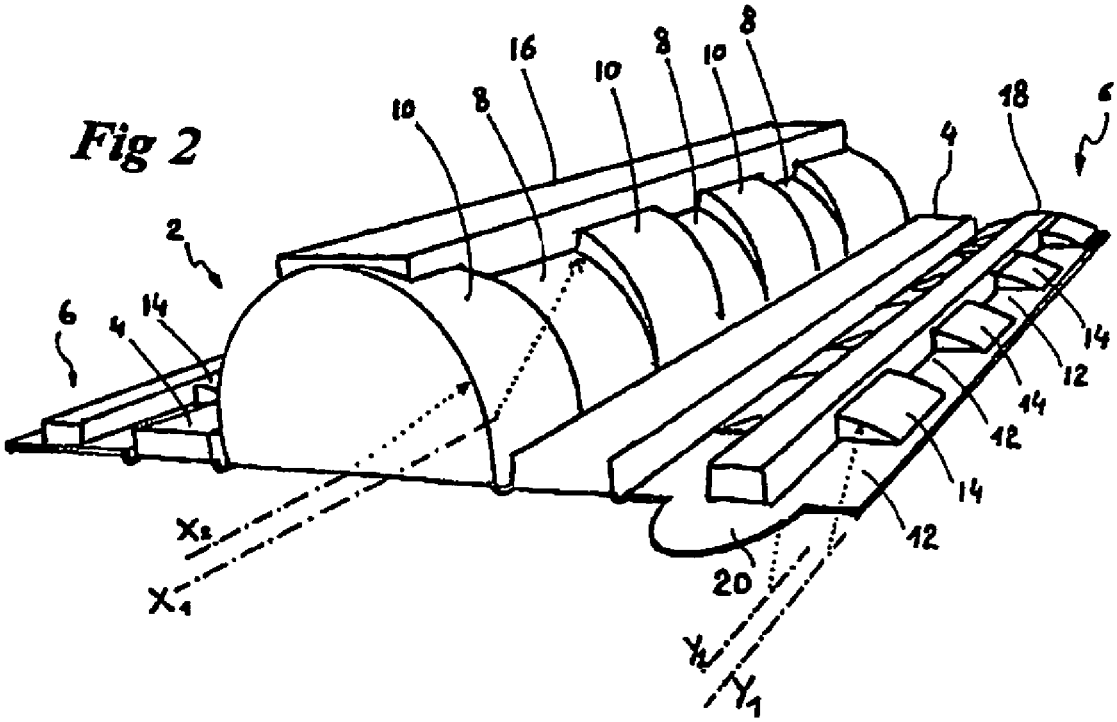
FIG. 2 is a perspective view of a packaging according to FIG. 1, upside down.

FIG. 2 shows more clearly another series of features of the packaging of the invention.

The rigidity of the packaging and its impact strength is provided by a series of reinforcing elements acting both as longitudinal beams and as shock-absorbing elements in case the partially or completely filled packaging is knocked or dropped. With this arrangement it is possible, other things being equal, to reduce the thickness of the plastic used. The first of these elements is the box-structure foot 16 of the cradle, which extends along practically the full length of the packaging. In the embodiment illustrated here, it will be seen that a small gap (between 0.5 and 2 mm approximately) has been provided between the bottoms of the length sections of the second series 10 and the bottom of the foot 16. The flaps 4 have the same role: they each form a box structure of generally parallelepiped shape, open towards the interior of the packaging, capable of absorbing and attenuating shocks. The covers, lastly, are each provided with a ridge 18, also of box structure, which extends along practically their full length. It will be noted that the ridges 18 also have a closing function by fitting one inside the other when the packaging is closed. In this regard they may also have a slight inverted taper, as is known to those skilled in the art. The design of the covers with their ridges 18 offers two significant advantages over conventional stud closures: they are stronger, which increases the reuse rate of the packaging, and they can be produced faster. For ease of opening and closing, the order in which the covers are overlapped is reversible (left over right or right over left).

An indirect advantage of these box-structure elements is that they present large flat surfaces on which indications can be placed relating to the packaging, to the type of coins for which it is designed, and so forth.

Besides having a ridge 18, it may also have engageable studs (not illustrated) for closing the covers 6.

A disadvantage of stud-type closures is that the studs are easily deformed during closing, especially if they are engaged incorrectly. It then becomes increasingly difficult to open them without spoiling them. A simple but effective means has therefore been provided to solve this problem, which takes the form of one or two tabs 20 attached to the covers 6.

The cradle, the flaps and the covers make maximum use of the elongation properties of plastics. It will also be observed that the cradle is deeper than the cradles of earlier packaging: the lower coins are embraced here around an angle of at least 180°. This may also be the case with the higher coins, which are therefore held around an angle of nearly 180° or more.

Another advantage of the packaging of the invention is that it is smaller than, in particular, EP 1 262 927: its width corresponds to that of the packaged coins, and its height is limited by integrating the ridge 18 into the depressed parts of the cover. It is therefore easier to stack, and more importantly can be made from a plastic blank of smaller area. For the same mould area, productivity will therefore be increased.

This increased productivity compensates for a difference in cost in respect of more expensive polymers, such as PET, APET or PLA. This last, being produced from lactic acid, is easily biodegradable and therefore less harmful to the environment.

What is claimed is:

1. A reusable packaging for coins or tokens comprising:

a half-cylindrical cradle suitable for holding coins or tokens and formed by an alternation of a first series of half-cylindrical lengthwise sections with a common axis perpendicular to a plane of the coins or tokens, and a second series of half-cylindrical lengthwise sections with a common axis set back vertically from the first series, the axes of the first series and the second series being parallel;

two folding flaps arranged longitudinally on either side of the half-cylindrical cradle, wherein the two folding flaps are of a box structure and are hinged to the half-cylindrical cradle, and a free edge of each of the two folding flaps are each joined in a hinged manner to a cover; and the covers in the form of a cylindrical segment formed by an alternation of a first series of lengthwise sections of cylindrical segments with a common axis perpendicular to the plane of the coins or tokens and a second series of lengthwise sections of cylindrical segments with a common axis set back vertically from the first series, wherein the axes of the first series and the second series of lengthwise sections of cylindrical segments is parallel, the covers corresponding to each of the two folding flaps being mutually engageable, and the half-cylindrical cradle comprising a box-structure foot extending virtually along a full length.

2. A reusable packaging according to claim 1, wherein the covers each comprise a longitudinal projection, the longitudinal projections of the covers being mutually engageable.

3. A reusable packaging according to claim 1, wherein at least one engageable stud is provided on each of the covers.

4. A reusable packaging according to claim 1, wherein at least one engageable stud is provided on each of the covers.

5. A reusable packaging according to claim 1, wherein at least the lengthwise sections of the second series of the half-cylindrical cradle encircle the coins or tokens around an angle of at least 180°.

6. A reusable packaging according to claim 5, wherein the lengthwise sections of the first series of the half cylindrical cradle encircle the coins or tokens around an angle of at least 180°.

7. A reusable packaging according to claim 3, wherein at least the lengthwise sections of the second series of the half-cylindrical cradle encircle the coins or tokens around an angle of at least 180°.

8. A reusable packaging according to claim 7, wherein the lengthwise sections of the first series of the half-cylindrical cradle encircle the coins or tokens around an angle of at least 180°.

9. A reusable packaging according to claim 1, wherein at least one of the covers comprises an external longitudinal tab.

10. A reusable packaging according to claim 1, wherein the box-structure foot of the half-cylindrical cradle comprises indications placed on an external surface.

11. A reusable packaging according to claim 1, wherein the reusable packaging is made of a plastic chosen from PET, APET and PLA.

12. A reusable packaging according to claim 3, wherein the box-structure foot of the half-cylindrical cradle comprises indications placed on an external surface.

13. A reusable packaging according to claim 3, wherein the reusable packaging is made of a plastic chosen from PET, APET and PLA.

14. A reusable packaging according to claim 5, wherein the box-structure foot of the half-cylindrical cradle comprises indications placed on an external surface.

15. A reusable packaging according to claim 5, wherein the reusable packaging is made of a plastic chosen from PET, APET and PLA.

* * * * *

UNITED STATES PATENT AND TRADEMARK OFFICE

CERTIFICATE OF CORRECTION

PATENT NO. : 7,395,921 B2
APPLICATION NO. : 10/552045
DATED : July 8, 2008
INVENTOR(S) : Errera It is certified that error appears in the above-identified patent and that said Letters Patent is hereby corrected as shown below:

Claims 4, Column 4, line 32: "1" should read as --2--

Signed and Sealed this

Second Day of September, 2008

JON W. DUDAS
*Director of the United States Patent and Trademark Office*